US009266325B2

(12) United States Patent
Tomizawa et al.

(10) Patent No.: US 9,266,325 B2
(45) Date of Patent: Feb. 23, 2016

(54) PRINT HEAD AND INKJET PRINTING APPARATUS

(75) Inventors: Keiji Tomizawa, Yokohama (JP); Masaki Oikawa, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/124,870

(22) PCT Filed: Aug. 10, 2012

(86) PCT No.: PCT/JP2012/005112

§ 371 (c)(1),
(2), (4) Date: Dec. 9, 2013

(87) PCT Pub. No.: WO2013/027368

PCT Pub. Date: Feb. 28, 2013

(65) Prior Publication Data

US 2014/0125737 A1 May 8, 2014

(30) Foreign Application Priority Data

Aug. 25, 2011 (JP) ..... 2011-183559

(51) Int. Cl.
*B41J 2/14* (2006.01)

(52) U.S. Cl.
CPC *B41J 2/14* (2013.01); *B41J 2/1404* (2013.01); *B41J 2002/14169* (2013.01); *B41J 2002/14475* (2013.01)

(58) Field of Classification Search
USPC ..... 347/47, 44, 20
See application file for complete search history.

(56) References Cited

U.S. PATENT DOCUMENTS

| | | | |
|---|---|---|---|
| 6,457,796 | B1 | 10/2002 | Fujii |
| 7,506,962 | B2 | 3/2009 | Murakami et al. |
| 7,677,697 | B2 | 3/2010 | Ozawa et al. |

(Continued)

FOREIGN PATENT DOCUMENTS

| | | | |
|---|---|---|---|
| CN | 101316712 | A | 12/2008 |
| EP | 1 149 705 | A1 | 10/2001 |

(Continued)

OTHER PUBLICATIONS

International Preliminary Report on Patentability and Written Opinion in International Patent Application No. PCT/JP2012/005112, mailed Mar. 6, 2014.

(Continued)

*Primary Examiner* — Henok Legesse
(74) *Attorney, Agent, or Firm* — Fitzpatrick, Cella, Harper & Scinto

(57) ABSTRACT

The print head includes an energy generating element, a chamber for accommodating liquid, and an ejection opening arranged in a position corresponding to the energy generating element. The ejection opening includes at least one projection projecting inside of the ejection opening, the ejection opening having a first region between a front end of the projection and an inner wall of the ejection opening positioned at the shortest distance from the front end, and second regions positioned on both sides of the projection and different from the first region, and when a width of the projection at a chamber-side opening face is represented as a1 and the maximum width of the projection is represented as a2, a relation a1<a2 is established and the width of the projection decreases gradually or step by step from a position having the width of a2 to the chamber-side opening face.

16 Claims, 12 Drawing Sheets

(56) References Cited

U.S. PATENT DOCUMENTS

| | | | | |
|---|---|---|---|---|
| 7,887,159 | B2 | 2/2011 | Takei et al. | |
| 7,926,912 | B2 | 4/2011 | Murakami et al. | |
| 8,025,362 | B2 | 9/2011 | Murakami et al. | |
| 8,167,407 | B2 | 5/2012 | Murakami et al. | |
| 8,303,082 | B2 | 11/2012 | Menzel et al. | |
| 8,382,248 | B2 | 2/2013 | Murakami et al. | |
| 2001/0055048 | A1* | 12/2001 | Lee et al. | 347/56 |
| 2002/0057311 | A1 | 5/2002 | Ogawa | |
| 2006/0000925 | A1 | 1/2006 | Maher et al. | |
| 2007/0146437 | A1* | 6/2007 | Murakami et al. | 347/61 |
| 2007/0176976 | A1* | 8/2007 | Fujiwara | 347/65 |
| 2010/0118089 | A1 | 5/2010 | Ozawa et al. | |
| 2010/0220148 | A1 | 9/2010 | Menzel et al. | |

FOREIGN PATENT DOCUMENTS

| | | | |
|---|---|---|---|
| JP | 2001-001522 | A | 1/2001 |
| JP | 2007-260661 | A | 10/2007 |
| JP | 2008-290380 | A | 12/2008 |
| JP | 2010-240639 | A | 10/2010 |
| WO | 2007/064021 | A1 | 6/2007 |

OTHER PUBLICATIONS

Office Action in Chinese Patent Application No. 201280040442.8, dated Dec. 22, 2014.

Office Action in Japanese Patent Application No. 2011-183559, dated Mar. 24, 2015.

* cited by examiner

PRINT HEAD AND INKJET PRINTING APPARATUS

TECHNICAL FIELD

The present invention relates to a print head which ejects liquid drops on a medium for printing, and an inkjet printing apparatus using the print head.

BACKGROUND ART

As to a method of ejecting a liquid of ink or the like, there is known a method of using an ejection energy-generating element such as a heat generating element (heater) or the like to bring a liquid to a boil to generate an air bubble, a pressure of which causes a liquid drop to be ejected from an ejection opening in the print head. In regard to such a liquid drop ejecting method, there are provided a bubble through jet (hereinafter, called also BTJ) ejection method in which an air bubble in the print head is communicated with the atmosphere in the liquid drop ejection process and a bubble jet ejection method in which the air bubble in the print head is not communicated with the atmosphere in the liquid drop ejection process. FIG. 8A to FIG. 8H are pattern diagrams showing a general ejection process in the BTJ ejection method by using a cross-section of the ejection opening vicinity in the print head.

According to the liquid ejection method, when a liquid to be ejected in the liquid drop ejection process is separated from the liquid in the print head to form a liquid drop, there may possibly occur a phenomenon where the separated liquid drop is divided into a liquid drop (hereinafter, called a main drop) which should be originally used for printing and a side liquid drop (hereinafter, called a satellite). There are some cases where degradation of image quality is caused by the event that the satellite lands on a print medium at a large distance from the main drop or the satellite loses its speed before reaching the print medium to be formed as a floating liquid drop (hereinafter, called a mist), possibly causing contamination of the print medium.

For a reduction of the satellite, for example, as described in Japanese Patent Laid-Open No. 2008-290380 or the like, it is known to shorten a length of an ink tail (tail of a liquid extending in a columnar shape) in the liquid drop to be ejected. Japanese Patent Laid-Open No. 2008-290380 discloses a technology that an ejection opening is provided with a projection projecting inside thereof to limit an amount of the liquid involved in the ink tail, whereby the length of the ink tail is shortened to reduce the satellite.

SUMMARY OF INVENTION

Technical Problem

However, the configuration of the ejection opening provided with the projection projecting inside thereof described in Japanese Patent Laid-Open No. 2008-290380 raises a new problem. That is, in a case of applying the ejection opening provided with the projection described in Japanese Patent Laid-Open No. 2008-290380 to the print head of the BTJ ejection method, there is a tendency that a deviation in a landing-on position of the ejected liquid drop easily occurs, thereby possibly degrading image quality.

In detail, according to the BTJ ejection method, in the liquid drop ejection process from the print head, a meniscus of the liquid backs from an atmosphere-side opening face of the ejection opening to a bubble generating chamber as a chamber where the liquid is accommodated and a heater is provided to generate an air bubble, ejecting the liquid around the time when the atmosphere and the air bubble are communicated. In the ejection opening provided with the projection described in Japanese Patent Laid-Open No. 2008-290380, the meniscus of the dropping-back liquid is divided into plural meniscuses in such a manner as to avoid the projection, which then drop down to a region having a relatively low fluid resistance. This state of the liquid drop ejection process is illustrated by an example in FIG. 9A and FIG. 9B, and an example in FIG. 10A and FIG. 10B. FIG. 9A and FIG. 9B are the example where two projections 11 of an ejection opening 32 are arranged such that projection directions of the two projections are in agreement with a longitudinal direction (X direction) of an ink flow passage 5. FIG. 10A and FIG. 10B are the example where two projections 11 of the ejection opening 32 are arranged such that projection directions of the two projections are in agreement with a width direction (Y direction) of the ink flow passage 5. As shown in FIG. 9B and FIG. 10B, the plural meniscuses divided by the projections 11 respectively drop down to locations at a distance from the center of the air bubble. Therefore, communication between the atmosphere and the air bubble can occur at the plural locations at a distance from the air bubble center. Then the interface of the air bubble generated on a heater 31 in a bubble generating chamber 6 may slightly change for each ejection event due to an influence of micro disturbances (for example, uptake bubbles, a tiny change of film boiling, and the like).

Therefore, in the print head of the BTJ ejection method having the ejection opening provided with the projection described in Japanese Patent Laid-Open No. 2008-290380, the number or the places of communication locations between the atmosphere and the air bubble tend to easily differ for each ejection event. For example, depending on each ejection event, the number of the communication locations is one or more, or the communication location is placed at an upper part or a lower part in the bubble generating chamber. In this manner, the communication state is not constant. As a result, in a case of performing continuous ejections, the communication state differs in each ejection to change an ejection angle or an ejection speed of the ejected liquid drop. Therefore, there is a tendency that the deviation of the landing-on position of the liquid drop occurs to create degradation in image quality. This tendency becomes remarkable with rising temperature, in continuous printing, and at a large printing duty ratio (ink application amount onto a print medium per unit area). Therefore, the present invention has an object of providing an inkjet print head and an inkjet printing apparatus which can achieve a satellite reduction effect, and can prevent the deviation of the landing-on position of the ejected liquid drop to suppress degradation in image quality due to the deviation.

Solution to Problem

For solving the above problem, a print head according to the present invention includes an energy generating element, a chamber for accommodating liquid to which energy is applied from the energy generating element, and an ejection opening arranged in a position corresponding to the energy generating element for ejecting the liquid from the chamber to an outside, thus applying the energy to the liquid in the chamber from the energy generating element to eject the liquid from the ejection opening, wherein the ejection opening includes: at least one projection projecting inside of the ejection opening, the ejection opening having a first region between a front end of the projection and an inner wall of the ejection opening positioned at the shortest distance from the front end and second regions positioned on both sides of the projection and different from the first region, wherein when a width of the projection at a chamber-side opening face of the ejection opening is represented as a1 and a maximum width of the projection is represented as a2, a relation of the formula a1<a2 is established and the width of the projection decreases gradually or in a step-by-step manner from a position having the width of a2 to the chamber-side opening face.

Advantageous Effects of Invention

According to the present invention, the ink tail can be shortened to reduce the satellite, and the deviation in a landing-on position of the ejected liquid on the print medium can be prevented to suppress image degradation due to the deviation.

DESCRIPTION OF EMBODIMENTS

Before describing respective embodiments in the present invention, components commonly used among the respective embodiments will be explained.

"Print" in the present specification indicates formation of meaningful information such as characters or figures. Further, "print" broadly includes formation of images, designs, patterns and the like on a print medium regardless of presence/absence of meaning or whether or not it becomes obvious as to be visually perceptible. In addition, "print" also includes a case of processing a print medium by applying liquids on the print medium. "Print medium" in the present specification indicates not only a paper used in a general printing apparatus, but also broadly indicates an ink-acceptable medium such as clothing, plastic films, metallic plates, glass, ceramics, lumber, leathers, and the like. "Ink" or "liquid" in the present specification indicates a liquid for forming images, designs, patterns and the like by an application thereof on a print medium, and also includes a liquid as a processing agent for processing a print medium or for solidification or insolubilization of a liquid applied on a print medium. "Fluid resistance" in the present specification indicates an easiness level of liquid movement, and, for example, when a liquid is difficult to move in a narrow space, the fluid resistance is regarded as high, and when a liquid is easy to move in a wide space, the fluid resistance is regarded as low. Further, words such as "parallel", "orthogonal" and "perpendicular" allow errors within a range of the order of manufacturing errors.

Figure 6:
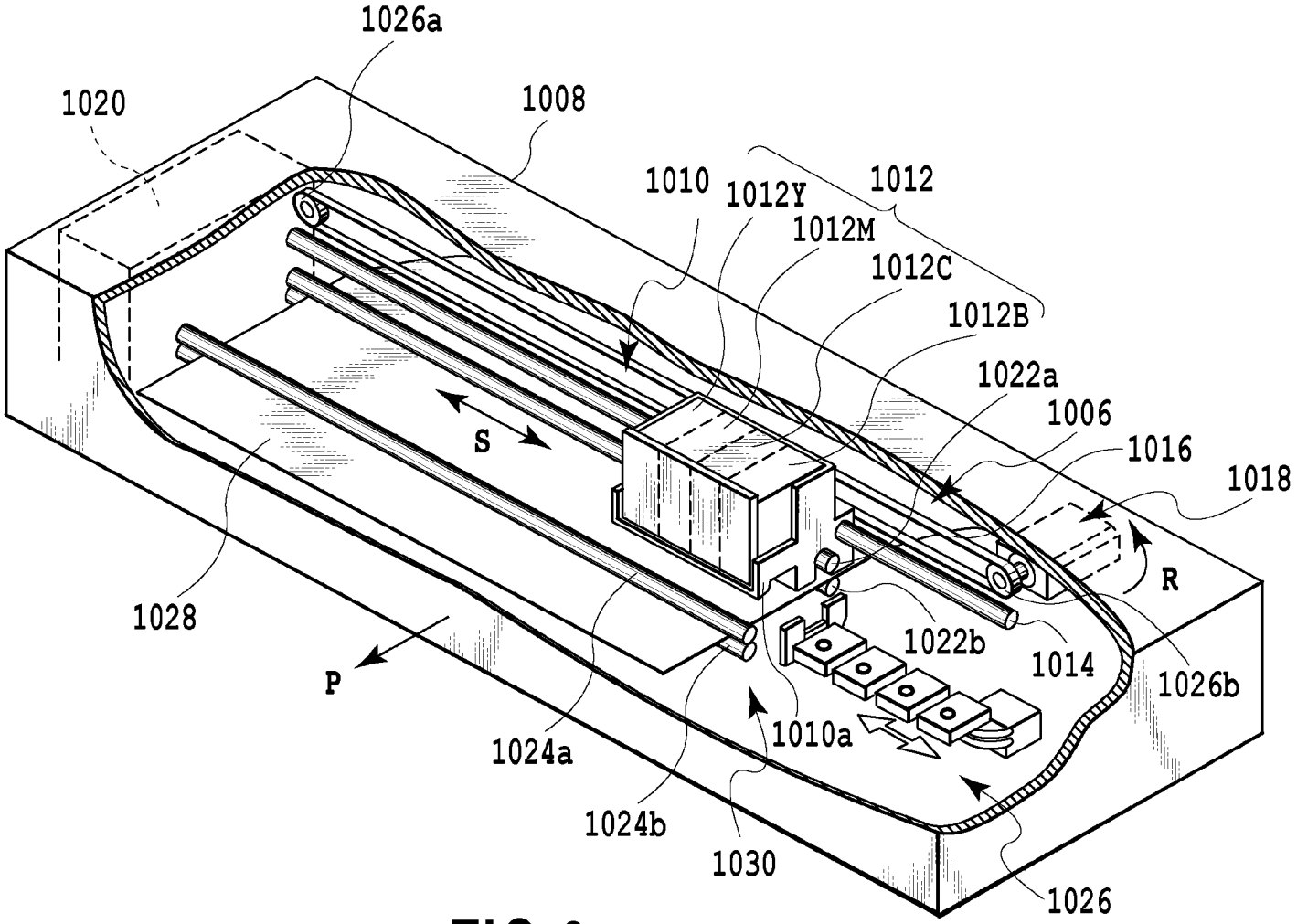
FIG. 6 is a schematic perspective view showing a key part of an inkjet printing apparatus which can be applied to the present invention.

Referring to the drawings, FIG. 6 is a schematic perspective view showing a key part of an example of an inkjet printing apparatus to which a print head of the present invention can be applied. The inkjet printing apparatus includes a conveyance apparatus 1030 for intermittently conveying a paper 1028 as a print medium into a casing 1008 in a direction of an arrow P. The inkjet printing apparatus includes a printing unit 1010 reciprocating in parallel to a direction S orthogonal to the conveyance direction P of the paper 1028 and having print heads for ejecting liquids, and a movement drive unit 1006 as drive means reciprocating the printing unit 1010. The conveyance apparatus 1030 includes a pair of roller units 1022*a* and 1022*b* arranged to oppose, in parallel to each other, a pair of roller units 1024*a* and 1024*b*, and a drive unit 1020 for driving each roller unit. When the drive unit 1020 is operated, the paper 1028 is tightly held between the roller units 1022*a* and 1022*b*, and between the roller units 1024*a* and 1024*b*, and is intermittently conveyed in the P direction. The movement drive unit 1006 includes a belt 1016 and a motor 1018. The belt 1016 is wound around pulleys 1026*a* and 1026*b* arranged to oppose each other by a predetermined interval on a rotational shaft, and is arranged in parallel to the roller units 1022*a* and 1022*b*. The motor 1018 drives the belt 1016 coupled to a carriage member 1010*a* in the printing unit 1010 in a forward direction and in a backward direction. When the motor 1018 is operated to rotate the belt 1016 in a direction of an arrow R, the carriage member 1010*a* moves by a constant movement amount in one of the directions shown by a double-headed arrow S in response to the rotation. In addition, when the belt 1016 rotates in a direction in reverse to the direction of the arrow R, the carriage member 1010*a* moves by a constant movement amount in a direction in reverse to the above one of the directions shown by the double-headed arrow S. Further, a recovery unit 1026 is provided in a position as a home position of the carriage member 1010*a* to oppose an ink ejection face of the printing unit 1010 for executing ejection recovery processing of the printing unit 1010. The printing unit 1010 has cartridges 1012 for ink removably equipped to the carriage member 1010*a*. The cartridges are provided, for example, in order of 1012Y, 1012M, 1012C and 1012B corresponding to the respective ink colors of yellow, magenta, cyan and black.

Figure 7:
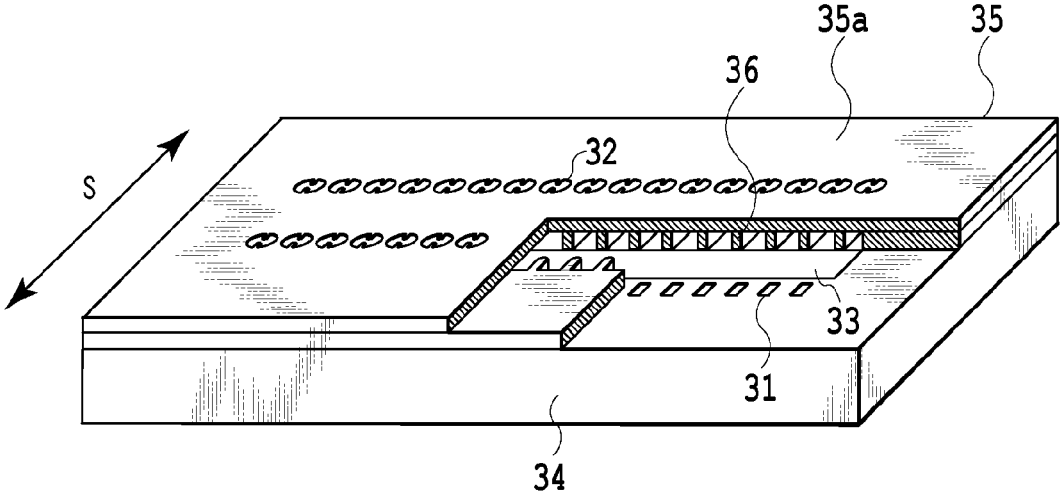
FIG. 7 is a schematic perspective view showing a key part of a print head of the present invention.
Figures 8A, 8B, 8C, 8D, 8E, 8F, 8G, 8H:
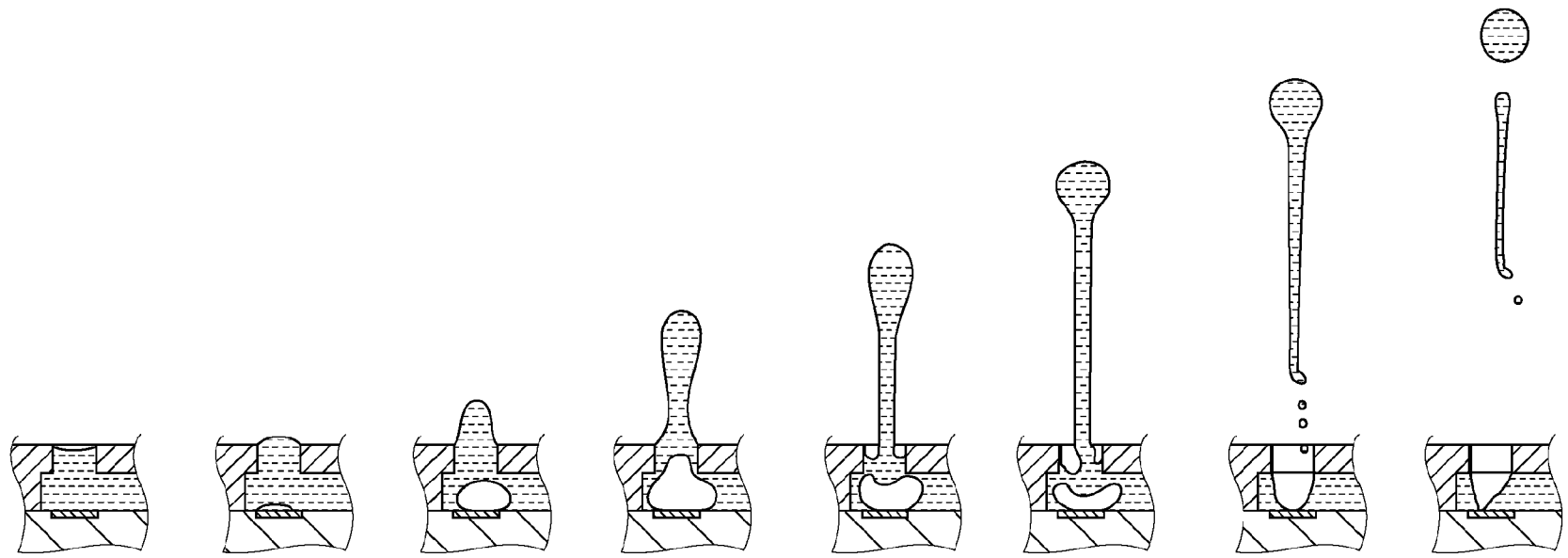
FIG.8A Prior Art
FIG.8B Prior Art
FIG.8C Prior Art
FIG.8D Prior Art
FIG.8E Prior Art
FIG.8F Prior Art
FIG.8G Prior Art
FIG.8H Prior Art
FIGS. 8A-8H are ejection process diagrams of a BTJ ejection method using a conventional ejection opening of a round type.
Figure 9A:
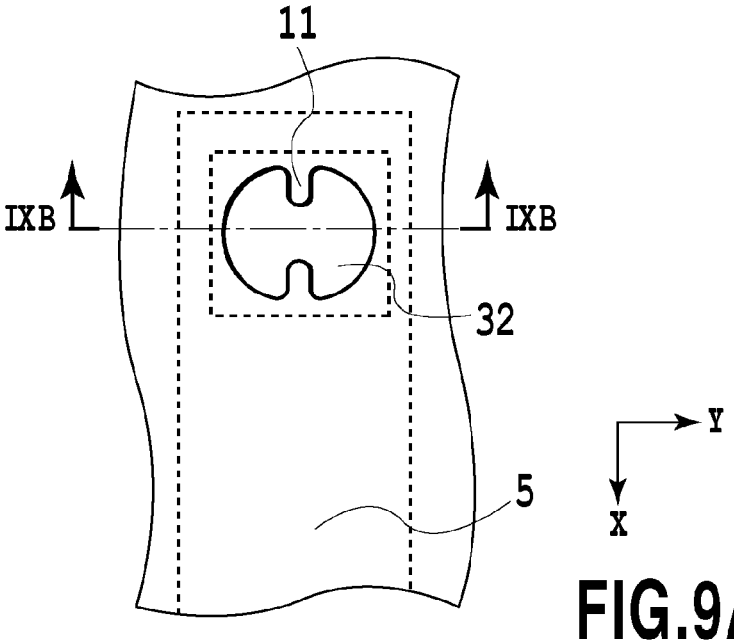
FIG.9A Prior Art
FIGS. 9A and 9B are diagrams explaining communication between the atmosphere and an air bubble at liquid drop ejecting in the print head of the BTJ ejection method using a conventional ejection opening with the projection.
Figure 9B:
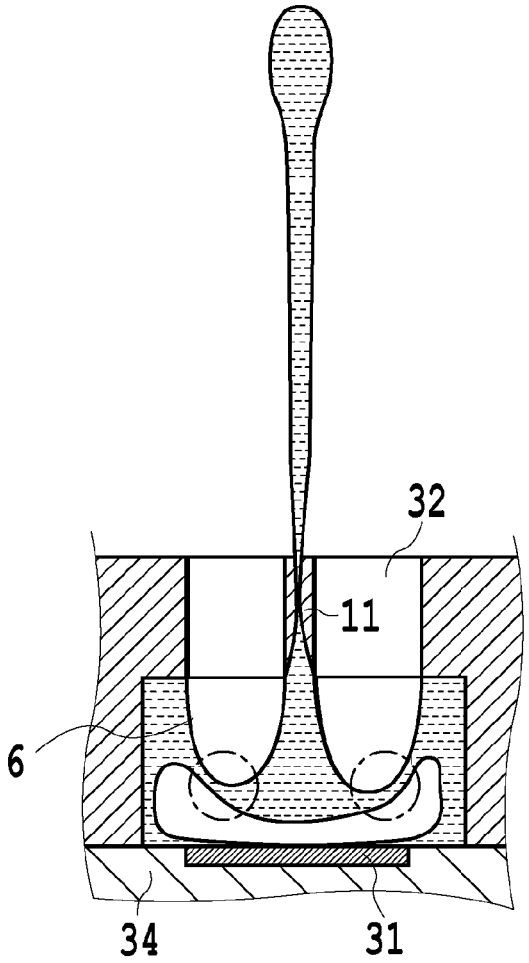
FIG.9B Prior Art
Figure 10A:
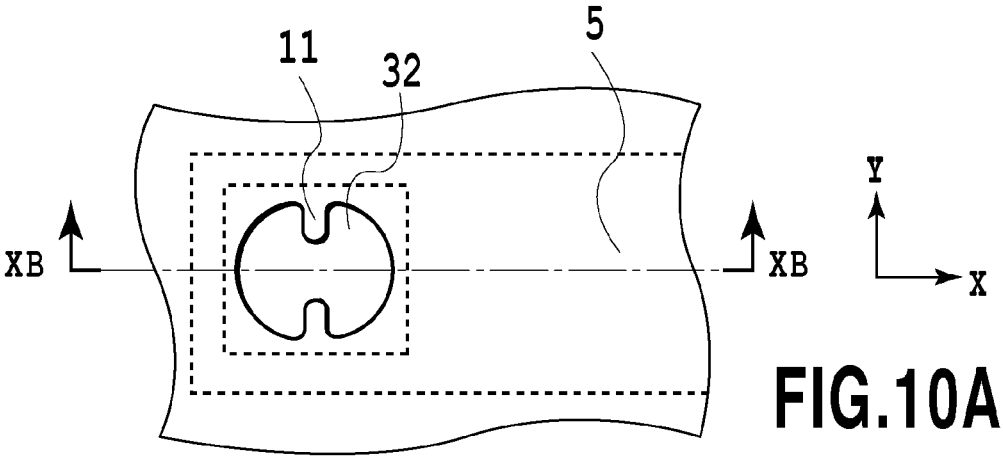
FIG.10A Prior Art
FIGS. 10A and 10B are diagrams explaining communication between the atmosphere and an air bubble at liquid drop ejection in the print head of the BTJ ejection method using the conventional ejection opening with the projection.
Figure 10B:
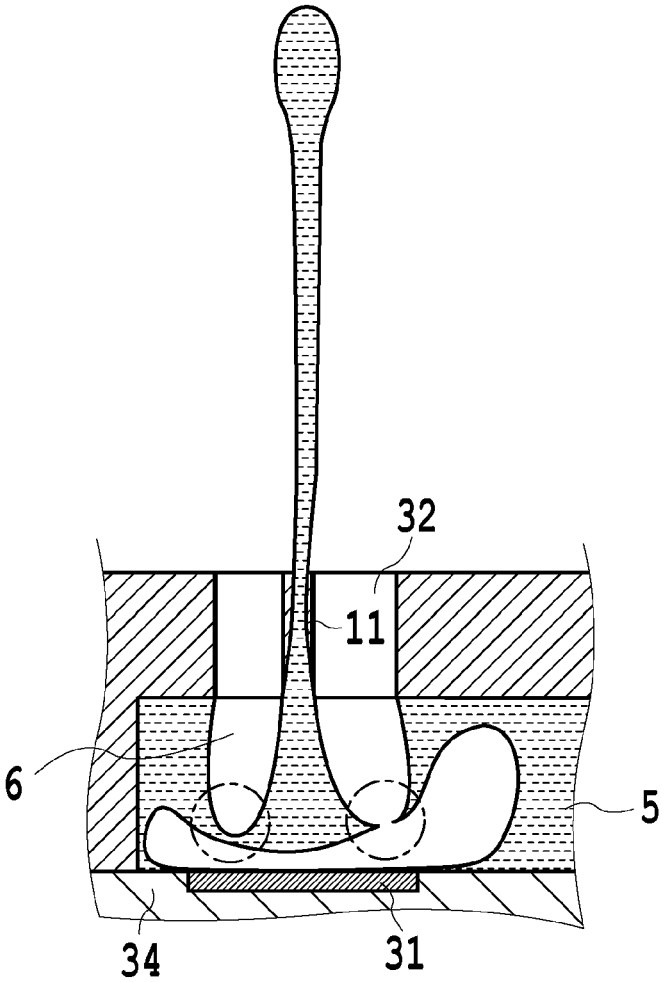
FIG.10B Prior Art

An explanation will be made of the print head of the present invention which can be mounted on the aforementioned inkjet printing apparatus. FIG. 7 is a schematic perspective view diagrammatically showing a key part of the print head of the present invention. In FIG. 7, electrical wiring and the like for driving heat generating elements (heaters) 31 as energy generating elements are omitted. The double-headed arrow S in FIG. 7 indicates directions (main scan directions) where the print head and the print medium relatively move during a printing operation in which the print head ejects liquid drops. Here, as shown in FIG. 6, there is shown an example where the print head moves relative to the print medium during the printing operation. A substrate 34 is provided with a supply port 33 as a through-hole in an elongated groove shape for supplying liquids to a flow passage. Heater rows are arranged on both sides of the supply port 33 in a longitudinal direction such that the heat generating elements (heaters) 31 as thermal energy generating means are positioned in a zigzag manner, wherein the heater row is structured such that the heaters 31 are arranged by an interval of 600 dpi. This configuration allows an image to be printed to have a resolution of 1200 dpi. The substrate 34 is provided with flow passage walls 36 thereon as flow passage-forming members for forming flow passages, and an ejection opening plate 35 in which ejection openings 32 are formed. Each ejection opening 32 is arranged right above its corresponding heater 31 to form a bubble generating chamber accommodating a liquid therein for bubble generation between the ejection opening 32 and the heater 31.

First Embodiment

Figure 1A:
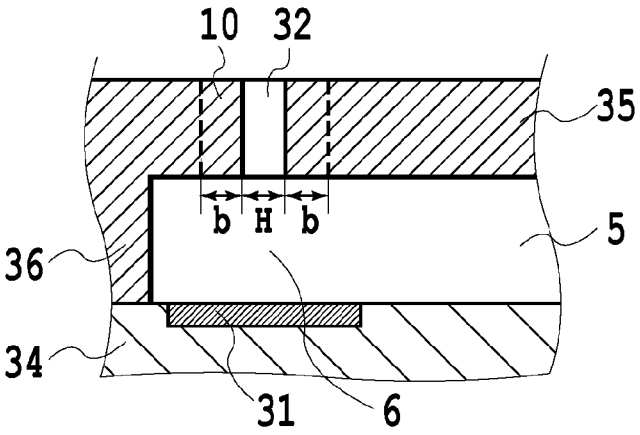
FIGS. 1A-1G are diagrams showing a major part of a print head according to a first embodiment in the present invention.
Figure 1B:
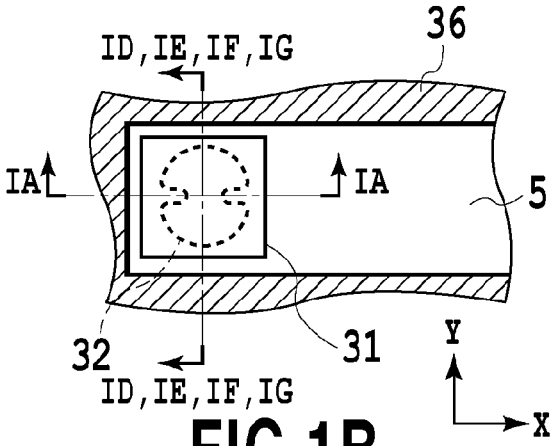
Figure 1C:
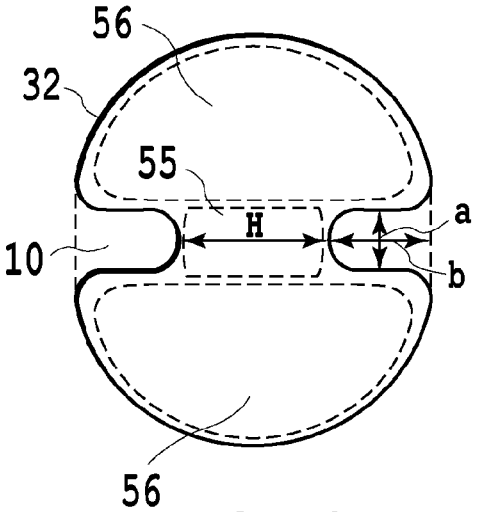
Figure 1D:
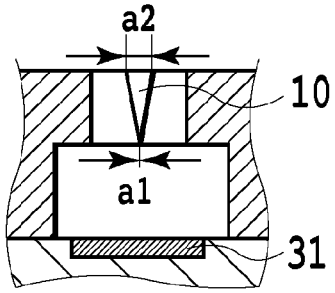

FIG. 1A to FIG. 1D show a major part of the print head according to the first embodiment in the present invention. FIG. 1A is a cross-section taken along an ejection direction of the liquid in the vicinity of the ejection opening 32 in the print head and is a diagram taken along a longitudinal direction (hereinafter, called also an X direction) of a flow passage 5 communicating the supply port 33 of the liquid and the ejection opening 32. FIG. 1B is a schematic diagram of a configuration of the heater 31 and the flow passage 5 as viewed from a side of the ejection opening 32. FIG. 1C shows a configuration of the ejection opening 32 at an ejection opening plate surface 35*a* (hereinafter, called also an atmosphere-side opening face). FIG. 1D is a cross-section taken along an ejection direction of the liquid in the vicinity of the ejection opening 32 in the print head and is a diagram taken in a direction perpendicular to the longitudinal direction of the flow passage 5, that is, taken along a width direction (hereinafter, called also a Y direction) of the flow passage 5.

The ejection opening 32 of the print head according to the present embodiment, as shown in FIG. 1C, has a substantially circular shape as viewed from an outside of the print head, that is, at the atmosphere-side opening face of the ejection opening 32, and includes two projections 10 projecting inside. In the figure, a width of the projection 10 is indicated by a, and a distance in projection of the projection 10 (hereinafter, called also a length of projection) from a virtual inner periphery of the ejection opening shown in a dotted line is indicated by b. The projections 10 are provided symmetrically in the ejection opening 32 and form a clearance having the shortest distance H between front ends of the projections 10. In the present embodiment, the two projections of the ejection openings 32 are arranged such that the projecting directions of the projections 10 are, as shown in FIG. 1B, in agreement with the longitudinal direction (X direction) of the flow passage 5.

As seen from FIG. 1A and FIG. 1D, the ejection opening 32 in a view with the projections 10 being removed is configured to be similar from the atmosphere-side opening face to the bubble generating chamber 6-side opening face of the ejection opening 32 on a cross-section perpendicular to a liquid ejection direction of the ejection opening 32, and is formed in a substantially cylindrical shape as a whole. On the other hand, the projection 10 of the ejection opening 32 has the configuration as described below in the liquid ejection direction of the ejection opening 32. That is, as shown in FIG. 1A, a length b of the projection 10 is similar from the atmosphere-side opening face to the bubble generating chamber 6-side opening face of the ejection opening 32. Therefore, since the ejection opening is formed in a substantially cylindrical shape as described above, the shortest distance H between the front ends of the projections 10 is made similar from the atmosphere-side opening face to the bubble generating chamber 6-side opening face of the ejection opening 32.

In contrast, as shown in FIG. 1D, the width of the projection 10 changes in the liquid ejection direction of the ejection opening 32. For explaining this change, the width of the projection 10 at the bubble generating chamber 6-side opening face of the ejection opening 32 is represented as a1, and a maximum value in the width of the projection 10 in a plane parallel to this face, that is, in the plane orthogonal to the liquid ejection direction, is represented as a2. The print head of the present invention is characterized in that the ejection opening is provided with the projection in which a relation of width a1<width a2 is established and the width decreases gradually or in a step-by-step manner from a position of width a2 to a position of width a1. In FIG. 1D, the projection 10 is configured in a triangle shape having the maximum width a2 at the atmosphere-side opening face and a height reaching the bubble generating chamber-side opening face to have this maximum width a2 as a base of the triangle. That is, the relation of width a1<width a2 is established and the width of the projection 10 gradually decreases from the position of width a2 toward the bubble generating chamber-side opening face.

Figures 11A, 11B, 11C:
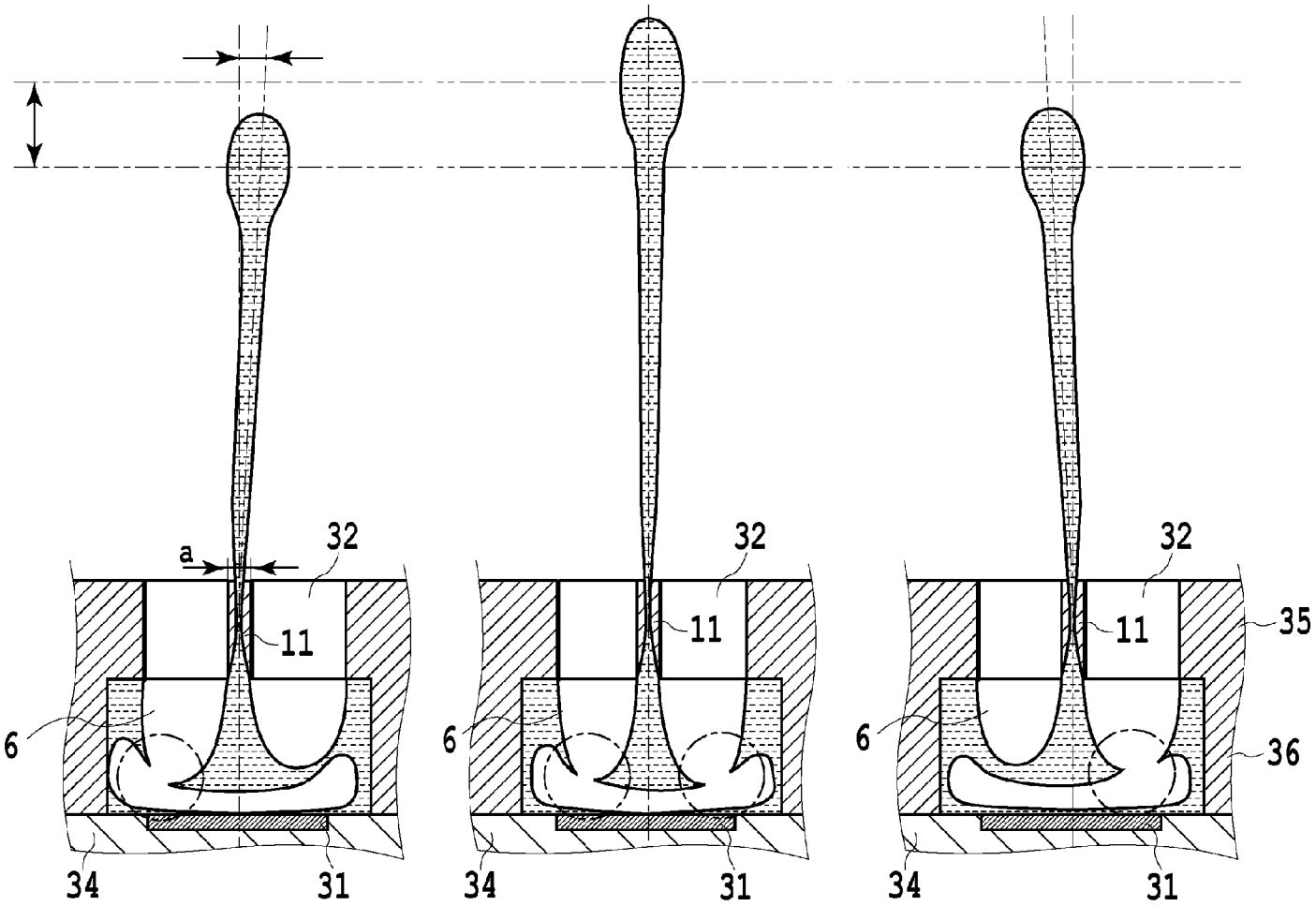
FIG.11A Prior Art
FIG.11B Prior Art
FIG.11C Prior Art
FIGS. 11A-11C are diagrams showing an atmosphere communication state and a state of disturbance in the ejection liquid drop in the conventional example shown in FIG. 9A and FIG. 9B.

An explanation will be made of the operation and effect of the print head according to the present embodiment having the above configuration, with reference to FIG. 11A to FIG. 11C, and FIG. 12A and FIG. 12B. FIG. 12B shows a cross-section taken along a direction (Y direction) orthogonal to the liquid ejection direction and the flow passage 5 in the vicinity of the ejection opening in the print head according to the first embodiment. FIG. 11A to FIG. 11C each show a cross-section taken along the liquid ejection direction and the Y direction in the vicinity of the ejection opening in the print head, which does not correspond to the present invention. The print head shown in FIG. 11A to FIG. 11C differs from the print head according to the first embodiment in the present invention in a point where a width a of the projection in the ejection opening is constant from the atmosphere-side opening face to the bubble generating chamber-side opening face of the ejection opening (that is, width a1=width a2). The explanation of the print head in the above first embodiment can be applied to the other components in the print head shown in FIG. 11A to FIG. 11C. FIG. 11A to FIG. 11C, and FIG. 12B are diagrams each in detail explaining a state where an air bubble in the print head is communicated with the atmosphere, in the liquid ejection process.

The print head shown in FIG. 12A and FIG. 12B (hereinafter, called also an embodiment), and the print head shown in FIG. 11A to FIG. 11C (hereinafter, called also a conventional example) each include the ejection opening 32 having the configuration as shown in FIG. 1C as viewed from an outside. By referring to FIG. 1C, a region corresponding to a distance H between the front ends of the projections 10 and the width a of the projection 10 in the ejection opening 32 forms a high fluid resistance region 55 as a first region in which the fluid is more difficult to move as compared to other regions and which has a remarkably high fluid resistance. In addition, the other regions, that is, the regions positioned on both sides of the high fluid resistance region 55 as a boundary (positions at both sides of the projections 10) form low fluid resistance regions 56 as second regions in which the fluid is relatively easy to move. In the embodiment and the conventional example, the projection 10 is provided from the atmosphere-side opening face over the bubble generating chamber-side opening face of the ejection opening 32.

First, an explanation will be made of a reduction effect of the satellite. In the process of ejecting a liquid from the print head, when the liquid is pushed out in a columnar shape from the ejection opening to an outside by an air bubble generated due to heating by the heater, the liquid in the ejection opening 32 is pulled into the bubble generating chamber 6 from the atmosphere-side opening face of the ejection opening. At this time, the meniscus of the liquid to be pulled in drops back to regions having a relatively low in fluid resistance (low fluid resistance regions 56 in FIG. 1C). On the other hand, in the region having a relatively high liquid resistance between the front ends of the projections 10 (high fluid resistance region 55 in FIG. 1C), a liquid surface (liquid film) connected to a columnar liquid (liquid column) during ejection is held. In this manner, the liquid in the ejection opening is left locally between the front ends of the projections, and thereby an amount of the liquid making contact with the liquid column as the ink tail can be reduced to separate the liquid column in the vicinity of the surface of the ejection opening plate. Therefore, according to the configuration of the print head in each of the present embodiment and the conventional example, the satellite can be reduced by shortening the ink tail.

Next, an explanation will be made of a prevention effect of the deviation in the landing-on position of the liquid drop to be ejected. As described above, the embodiment in FIG. 12A and FIG. 12B differs from the conventional example in a point of the configuration of the projection in the ejection opening in the width direction.

In the conventional example from FIG. 11A to FIG. 11C, the projection 11 provided in the ejection opening 32 consistently has the same width a from the atmosphere-side opening face to the bubble generating chamber-side opening face in the liquid ejection direction. The meniscus of the liquid in the ejection opening 32 having dropped back in the liquid ejection process is divided into two portions along the wall surface of the projection 11 configured as described above to drop down toward the bubble generating chamber 6 before making contact with the air bubble generated by heating by the heater 31. As a result, the air bubble and the atmosphere are communicated in the air bubble interface in a position at a distance from the center of the air bubble on the heater 31.

Here, the interface of the air bubble generated by heating by the heater tends to slightly change for ejection of each event due to an influence of micro disturbances, for example, an uptake bubble, a micro change of film boiling, and the like. Therefore, at the time the meniscus of the liquid drops back to establish communication between the air bubble and the atmosphere, there is a case where, as shown in FIG. 11A and FIG. 11C, the communication is made in one location or, as shown in FIG. 11B, in plural locations. In addition, there is a case where a communication position between the air bubble and the atmosphere is in a side of the ejection opening 32, in a side of the heater 31 or at both the sides thereof in the bubble generating chamber 6. Therefore, the conventional example has a tendency that the communication state between the air bubble and the atmosphere (hereinafter, called also an atmosphere communication state) differs slightly for each event and becomes unstable.

In this manner, in a case where the place of the atmosphere communication or the number of the atmosphere communication locations differs for each ejection at the time of performing the continuous ejections, an ejection angle or an ejection speed of the liquid differs in each ejection (refer to FIG. 11A to FIG. 11C). As a result, there occurs the deviation in the landing-on position of the ejected liquid, thereby causing image degradation. Such a phenomenon tends to easily occur at a continuously printing time, as well as at a temperature rising time, at a large print duty (large ink adhesion amount on a print medium per unit area), and the like.

Figure 12A:
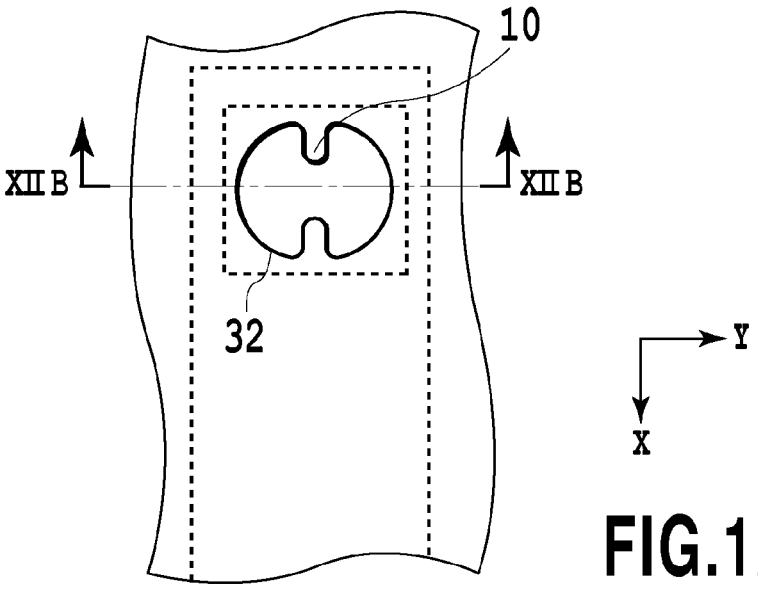
FIGS. 12A and 12B are diagrams showing an effect of the first embodiment in the present invention.
Figure 12B:
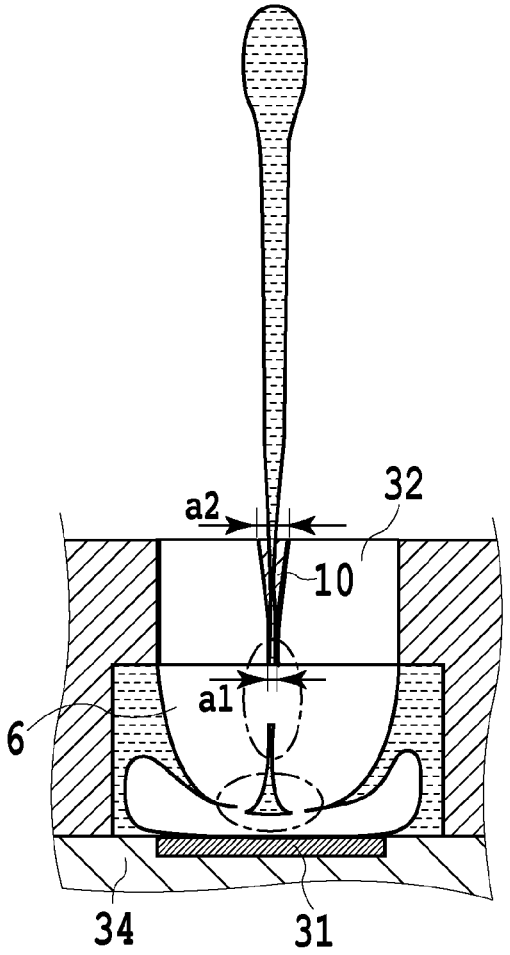

On the other hand, in the embodiment in FIG. 12A and FIG. 12B, the projection 10 provided in the ejection opening 32 is formed in a reverse triangle shape having the maximum width a2 on the atmosphere-side opening face and having the width a2 as a base to gradually decrease in width toward the bubble generating chamber-side opening face from the maximum width a2. In other words, the projection 10 in the embodiment is formed to gradually converge toward the center direction of the heater 31 from the ejection opening 32 to the bubble generating chamber 6. The meniscus of the liquid having dropped back in the liquid ejection process drops down to the bubble generating chamber 6 along the wall surface of the projection 10 configured as described above to drop down toward the bubble generating chamber 6 before making contact with the air bubble generated by heating by the heater 31. As a result, the air bubble and the atmosphere are communicated in the air bubble interface near the center of the air bubble on the heater 31, and as a result, the plural atmosphere communication locations exist at a nearby site with each other. Alternatively, the plural dropping-back meniscuses are connected to form one meniscus before atmosphere communication, and afterwards the one meniscus is atmosphere-communicated with the air bubble on the heater 31 (refer to FIG. 12B).

In this manner, a difference in the atmosphere communication state between the respective events is smaller in the embodiment as compared to the conventional example to alleviate the unstable atmosphere communication state. As a result, since the place of the atmosphere communication or the number of the atmosphere communication locations is substantially the same for each time of performing the continuous ejections and becomes stable, a change in the ejection angle or the ejection speed of the liquid in each ejection is made small. As a result, the deviation of the landing-on position of the ejected liquid on the print medium can be prevented, suppressing the image degradation due to it.

As described above, according to the embodiment, the ink tail can be shortened to reduce the satellite, and the deviation in a landing-on position of the ejected liquid on the print medium can be prevented to suppress the image degradation due to the deviation.

The first embodiment in the present invention is not limited to the aforementioned embodiment, and includes a modification achieving an effect similar to that of the embodiment. That is, in the aforementioned embodiment, the configuration of the projection 10 in the ejection opening in the width direction is, as shown in FIG. 1D, formed in a reverse triangle shape having the maximum width a2 on the atmosphere-side opening face and having the width a2 as the base to gradually decrease in width toward the bubble generating chamber-side opening face from the maximum width a2. However, the configuration of the projection applicable to the present invention also includes other configurations in which, when the width of the projection at the bubble generating chamber-side opening face is represented as a1 and the maximum width of the projection is represented as a2, the relation of a1<a2 is established and the width of the projection from a position of width a2 to a position of width a1 decreases gradually or in a step-by-step manner.

Figure 1E:
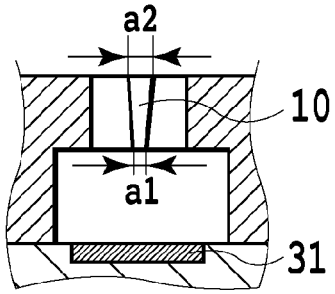
Figure 1F:
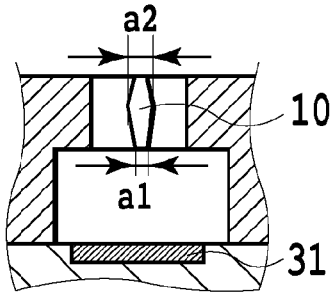
Figure 1G:
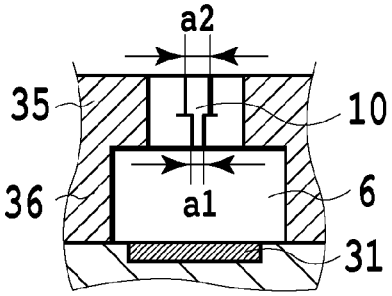

Non-limited special examples of the configuration of the projection in the ejection opening applicable to the present invention are shown in FIG. 1E to FIG. 1G. FIG. 1E to FIG. 1G are cross-sections taken along the ejection direction of the liquid in the vicinity of the ejection opening 32 in the print head, and diagrams orthogonal to the longitudinal direction (X direction) of the flow passage 5, that is, taken along the width direction (hereinafter, called also a Y direction) of the flow passage 5. In an example of FIG. 1E, the configuration of the projection 10 in the width direction is formed in a substantially trapezoidal shape having the maximum width a2 on the atmosphere-side opening face as the upper base and the width a1 on the bubble generating chamber-side opening face as the lower base. In an example of FIG. 1F, the configuration of the projection 10 in the width direction has the maximum width a2 in a position slightly closer to the atmosphere-side opening face between the atmosphere-side opening face and the bubble generating chamber-side opening face, and a gradually smaller width a1 of the projection toward the bubble generating chamber-side opening face. In an example of FIG. 1G, the configuration of the projection 10 in the width direction has the maximum width a2 of the projection on the atmosphere-side opening face and the minimum width a1 of the projection on the bubble generating chamber-side opening face, with step-by-step changes between the atmosphere-side opening face and the bubble generating chamber-side opening face. That is, in any example of FIG. 1E to FIG. 1G, a relation of width a1 of the projection<maximum width a2 of the projection on the bubble generating chamber-side opening face is established and the width of the projection 10 from a position of width a2 toward the bubble generating chamber-side opening face decreases gradually or in a step-by-step manner.

In any example of FIG. 1D to FIG. 1G, the width of the projection is sized to linearly change in the liquid ejection direction, but the width of the projection is not limited thereto. That is, a side face of the projection may change in a curved shape.

According to the first embodiment in the present invention explained above, the ink tail can be shortened to reduce the satellite, and the deviation in a landing-on position of the ejected liquid on the print medium can be prevented to suppress the image degradation due to the deviation.

Second Embodiment

FIG. 2A to FIG. 2G show a second embodiment in the present invention, and correspond to FIG. 1A to FIG. 1G in the first embodiment. In regard to components identical to those in the first embodiment, the explanation of the first embodiment thereof can be applied.

Figure 2A:
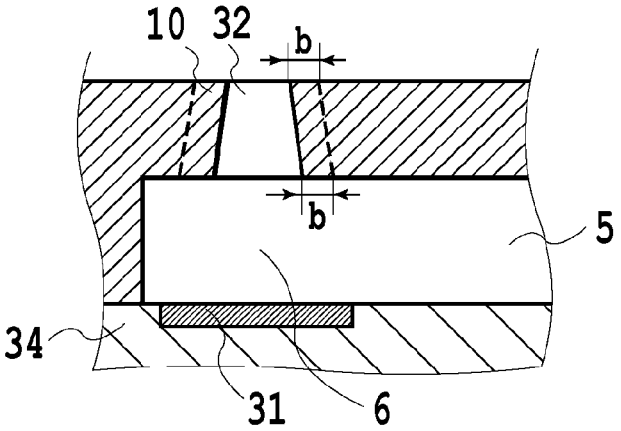
FIGS. 2A-2G are diagrams showing a major part of a print head according to a second embodiment in the present invention.
Figure 2B:
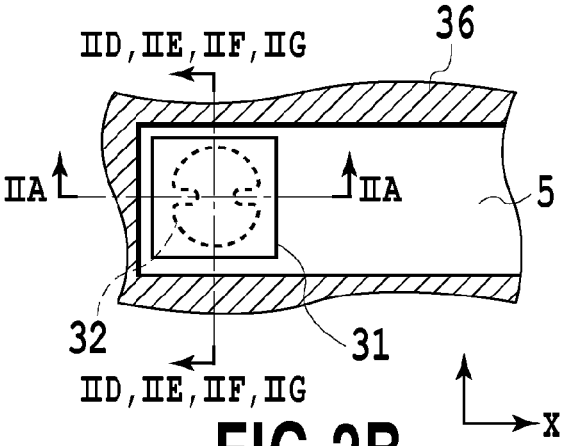
Figure 2C:
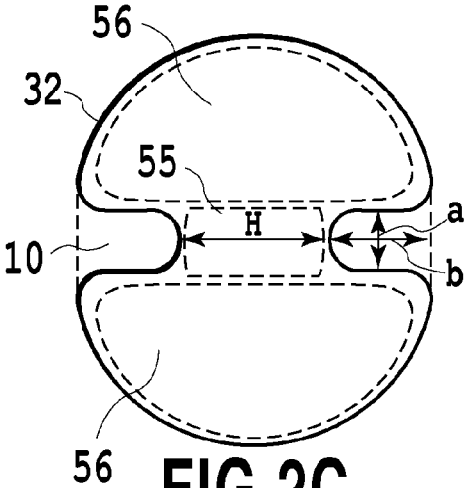
Figure 2D:
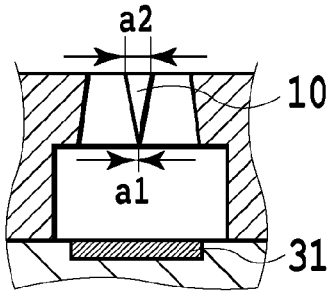
Figure 2E:
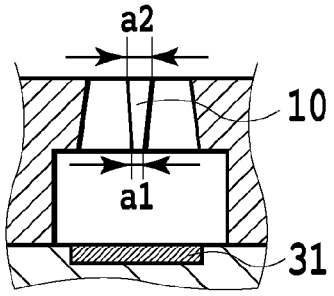
Figure 2F:
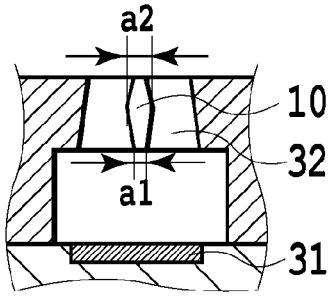
Figure 2G:
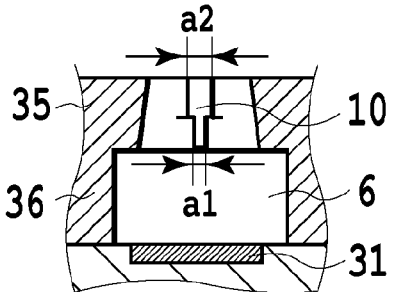
Figure 3A:
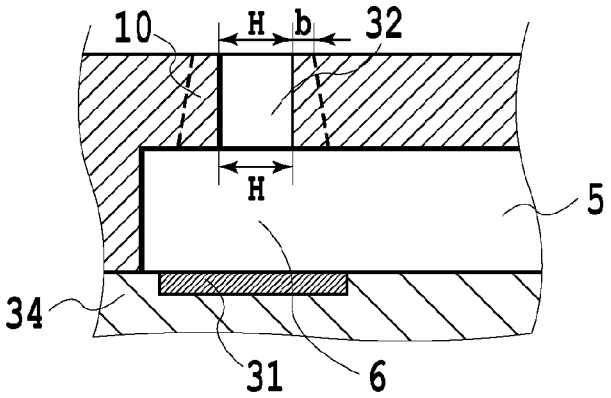
FIGS. 3A-3G are diagrams showing a major part of a print head according to a third embodiment in the present invention.
Figure 3B:
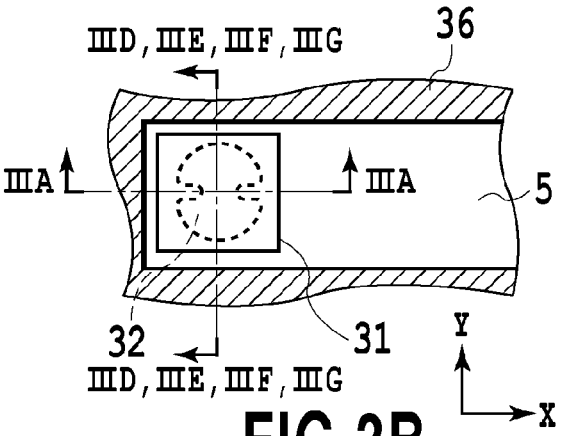
Figure 3C:
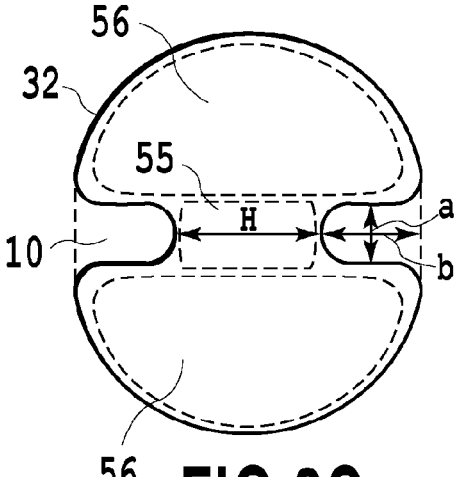
Figure 3D:
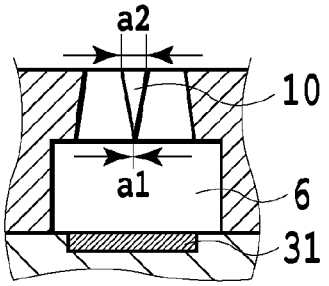
Figure 3E:
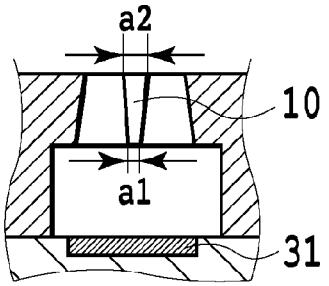
Figure 3F:
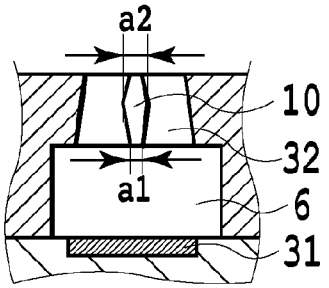
Figure 3G:
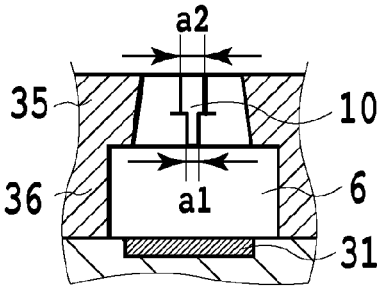

By referring to FIG. 2C, a print head in the second embodiment is provided with a substantially circular ejection opening having two opposing projections, front ends of which are spaced by a distance H and each of which has a width a and a length (projection distance from a virtual circumference of a circle) b, which is similar to the first embodiment as viewed from an outside. By referring to FIG. 2A, the projection 10 extends from the atmosphere-side opening face to the bubble generating chamber 6-side opening face of the ejection opening 32. With this configuration, the projection 10 in the second embodiment can locally leave the liquid in the ejection opening 32 between the front ends of the projections 10 in the liquid ejection process. Thereby an amount of the liquid making contact with the liquid column as the ink tail can be reduced and the liquid column can be separated near the surface of the ejection opening plate. Therefore, according to the configuration in the present embodiment, the ink tail can be shortened to reduce the satellite.

By referring to FIG. 2D to FIG. 2G, the projection in the second embodiment has the configuration in the width direction similar to that in the first embodiment. That is, the second embodiment includes the projection of the configuration in which, when the width of the projection at the bubble generating chamber-side opening face is represented as a1 and the maximum width of the projection is represented as a2, the relation of a1<a2 is established and the width of the projection from a position of width a2 to a position of width a1 decreases gradually or in a step-by-step manner. According to this configuration, the meniscus of the liquid having dropped back in the liquid ejection process drops down along the wall surface of the projection 11 toward the bubble generating chamber 6 before making contact with the air bubble generated by heating by the heater. As a result, the air bubble and the atmosphere are communicated in the air bubble interface near the center of the air bubble on the heater 31, and as a result, the plural atmosphere communication locations exist at a nearby site with each other. Alternatively, the plural dropping-back meniscuses are connected to form one meniscus before atmosphere communication, and afterwards the one meniscus is atmosphere-communicated with the air bubble on the heater 31. Therefore, according to the second embodiment, the atmosphere communication state in the ejection process can be stabilized to reduce a change in the ejection angle or the ejection speed of the liquid in each ejection to be small. As a result, the deviation in the landing-on position of the ejected liquid can be prevented, suppressing the image degradation due to it.

Here, the second embodiment differs from the first embodiment in a point of the configuration of the ejection opening 32 in a view with the projections 10 being removed. That is, in the first embodiment, the configuration of the ejection opening 32 in a view with the projections 10 being removed has a substantially cylindrical shape. On the other hand, in the second embodiment, the configuration of the ejection opening 32 in a view with the projections 10 being removed has a tapered shape in which a diameter of a substantially circular shape gradually increases from the atmosphere-side opening face to the bubble generating chamber-side opening face. With this configuration, in the second embodiment, the fluid resistance of the entire ejection opening 32 is small, the ejection failure due to an increasing viscosity of ink is difficult to occur, and the ejection efficiency is excellent. Therefore the heater 31 can be sized to be small and the print head with a little temperature rise can be provided. As a result, according to the present embodiment, a temperature rise which can be the cause of the deviation of the landing-on position can be suppressed to further suppress occurrence of the deviation of the landing-on position.

Third Embodiment

FIG. 3A to FIG. 3G show a third embodiment in the present invention. In regard to components identical to those in the first or second embodiment, the explanation in the first or second embodiment thereof can be applied.

The third embodiment will be explained by comparison with the second embodiment. In the second embodiment, by referring to FIG. 2A and FIG. 2C, the length b of the projection 10 (projection distance from a virtual circumference of a circle) is constant from the atmosphere-side opening face to the bubble generating chamber-side opening face of the ejection opening. Therefore, the distance H between the front ends of the projections 10 becomes larger from the atmosphere-side opening face toward the bubble generating chamber 6-side opening face. On the other hand, in the third embodiment, a length b of the projection 10 (projection distance from a virtual circumference of a circle) changes such that a distance H between the front ends of the projections 10 becomes constant from the atmosphere-side opening face to the bubble generating chamber 6-side opening face of the ejection opening. That is, the virtual circumference of the circle in the ejection opening spreads in a tapered shape from the atmosphere-side opening face to the bubble generating chamber 6-side opening face of the ejection opening. On the other hand, the length b of the projection is longer from the atmosphere-side opening face toward the bubble generating chamber 6-side opening face of the ejection opening, and the front ends of the projections 10 are kept to be in parallel to each other.

According to the third embodiment, the ink tail can be shortened to stabilize the atmosphere communication state and to suppress a rise in temperature by the configuration similar to that of the second embodiment. Thereby, a reduction in the satellite can be made, and occurrence of the deviation of the landing-on position can be suppressed. In addition thereto, according to the third embodiment, the front ends of the projections kept substantially in parallel to each other have a strong force of holding the liquid, making it possible to further shorten the ink tail and enhance a reduction effect of the satellite.

Fourth Embodiment

FIG. 4A to FIG. 4G show a fourth embodiment in the present invention. In regard to components identical to those in the first embodiment, an explanation thereof can be applied.

The fourth embodiment will be explained by comparison to the first embodiment. In the first embodiment, the configuration of the ejection opening 32 in a view with the projections 10 being removed has a substantially cylindrical shape. On the other hand, in the fourth embodiment, the configuration of the ejection opening 32 in a view with the projections 10 being removed is made by a combination of substantial cylinders having different diameters in which each diameter step-by-step increases from the atmosphere-side opening face to the bubble generating chamber-side opening face. A length b of the projection 10 (projection distance from a virtual circumference of a circle) in the ejection opening 32 step-by-step changes in the liquid ejection direction such that a distance H between the front ends of the projections 10 becomes constant.

According to the fourth embodiment, the ink tail can be shortened to stabilize the atmosphere communication state by the configuration similar to that of the first embodiment. Thereby a reduction in the satellite can be made, and occurrence of the deviation of the landing-on position can be suppressed. In addition thereto, according to the configuration in the fourth embodiment where the virtual circumference of the circle in the ejection opening step-by-step increases from the atmosphere-side opening face toward the bubble generating chamber-side opening face of the ejection opening, the fluid resistance of the entire ejection opening 32 is made small, the ejection failure due to an increasing viscosity of ink is difficult to occur, and the ejection efficiency is excellent. Therefore, the heater 31 can be sized to be small and the print head with little temperature rise can be provided. As a result, according to the fourth embodiment, a temperature rise which can be the cause of the deviation of the landing-on position can be suppressed to further suppress occurrence of the deviation of the landing-on position.

Figure 4A:
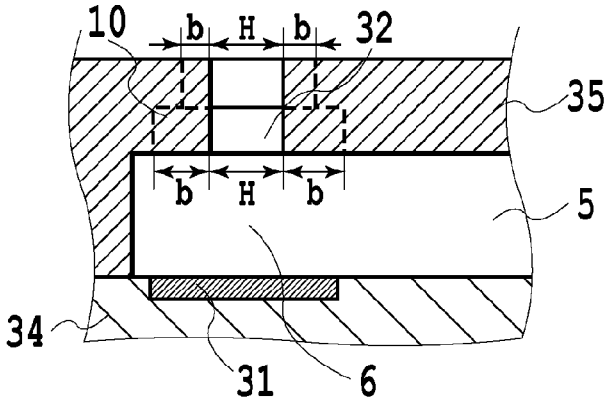
FIGS. 4A-4G are diagrams showing a major part of a print head according to a fourth embodiment in the present invention.
Figure 4B:
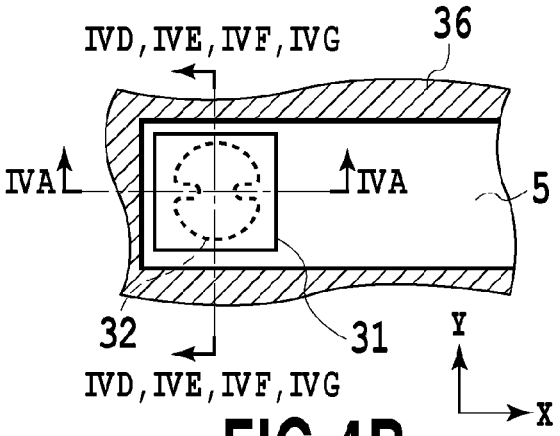
Figure 4C:
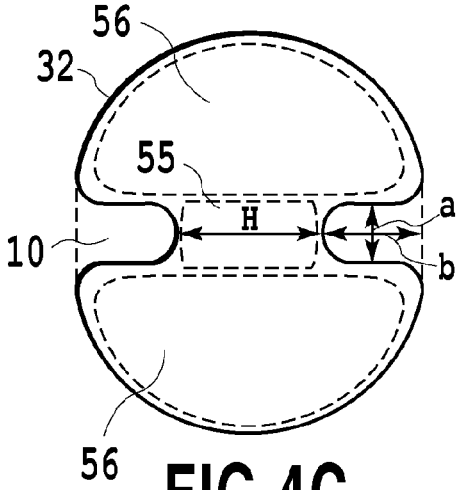
Figure 4D:
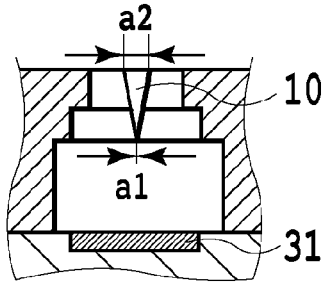
Figure 4E:
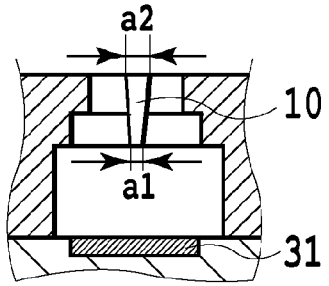
Figure 4F:
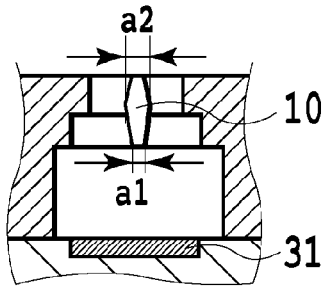
Figure 4G:
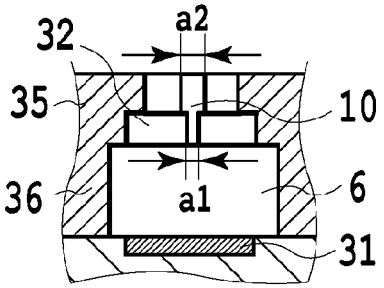

It should be noted that in FIG. 4A, the configuration of the ejection opening in a view with the projection being removed has the configuration by a combination of the two substantial cylinders of different diameters, but the present invention is not limited thereto, and may adopt the configuration by a combination of three or more substantial cylinders having different diameters, as the configuration in a view with the projection being removed.

Other Embodiments

Any of the above embodiments is explained by using an example where the two projections 10 in the ejection opening 32 are arranged such that the projection directions of the projections are in agreement with the longitudinal direction (X direction) of the flow passage 5. The present invention is, however, not limited thereto. That is, in the print head of the present invention, the two projections 10 in the ejection opening 32 may be arranged such that the projection directions of the projections 10 are in agreement with the width direction (Y direction) of the flow passage 5 or inclined to the X and Y directions.

Figure 5A:
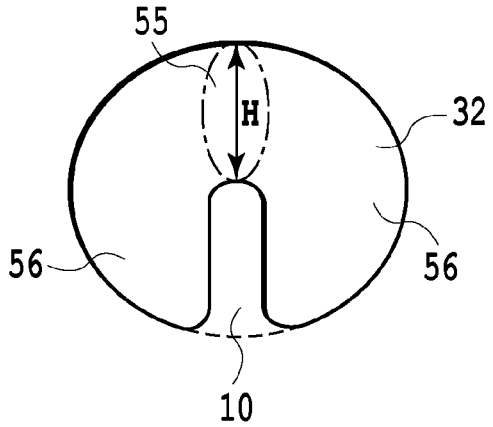
FIG. 5A is a pattern diagram of an ejection opening having one projection which can be applied to the present invention.
Figure 5B:
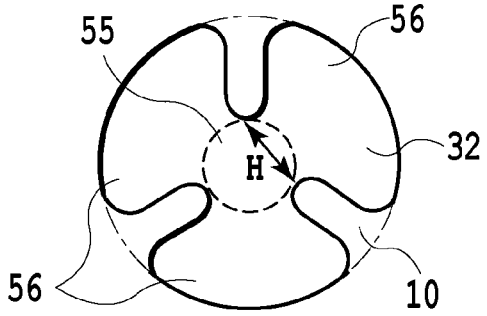
FIG. 5B is a pattern diagram of an ejection opening having three projections which can be applied to the present invention.

Any of the above embodiments is explained by using an example where the substantially circular ejection opening 32 has the two opposing projections 10, the front ends of which are spaced by the distance H, but the present invention is not limited thereto. That is, in the present invention, the number of the projections is not limited to two, and the ejection opening may include one projection as shown in FIG. 5A, three projections as shown in FIG. 5B, or more projections. The projections are arranged symmetrically in the ejection opening such that the clearance of the shortest distance H is formed between the front ends of the projections. When the number of the projections is one, the clearance of the front end of the projection indicates the shortest distance from the front end of the projection to the inner wall of the ejection opening. In a case where the plural projections are provided, the configuration of each projection may be sized to be different from each other. The present invention has one of the features that the projections formed in the ejection opening form the clearance H, which is a region having the relatively higher fluid resistance as compared to that of the other regions, and the high fluid resistance region differs largely in the fluid resistance as compared to that of the low fluid resistance region. It is preferable that in a case of the plural projections, the deviation in the landing-on position of the liquid to be ejected is difficult to occur in view of symmetry. On the other hand, when the number of the projections is excessively large, the configuration of the ejection opening becomes complicated, causing clogging of the liquid to be easily generated. Therefore, it is preferable to locally provide the projections, and it is preferable that the fluid resistance in the low fluid resistance region is not so much higher as compared to that of the ejection opening having the similar configuration except a point of having no projection. With this structure, the inner peripheral configuration of the ejection opening 32 on a plane perpendicular to the liquid ejection direction is not limited to the circle, but may adopt any configuration of an ellipse, a quadrangle and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-183559, filed Aug. 25, 2011, which is hereby incorporated by reference herein in its entirety.

REFERENCE CHARACTER LIST

5 Flow passage
6 Bubble generating chamber
10 Projection
31 Heat generating element (heater)
32 Ejection opening
35 Ejection opening plate
35*a* Ejection opening plate surface
36 Flow passage wall
55 High fluid resistance region
56 Low fluid resistance region
L Maximum diameter of an ejection opening
H Shortest distance from a projection front end to an ejection opening inner wall
a Width of a projection
a1 Width of a projection on a bubble generating chamber-side opening face of an ejection opening
a2 Maximum width of a projection on a plane perpendicular to a liquid ejection direction
b Length of a projection

The invention claimed is:

1. A print head comprising:

an energy generating element;

a chamber for accommodating liquid to which energy is applied from the energy generating element; and an ejection opening arranged in a position facing the energy generating element for ejecting the liquid from the chamber to outside, the energy being applied to the liquid in the chamber from the energy generating element to eject the liquid from the ejection opening, wherein the ejection opening includes at least one projection projecting in a projecting direction from an edge of the ejection opening towards a central portion of the ejection opening, the ejection opening having a first region between a front end of the projection and an inner wall of the ejection opening positioned at the shortest distance from the front end of the projection, and second regions positioned at both sides of the projection and being different from the first region, and wherein, when viewed from a direction of ejecting the liquid to the outside from the chamber, when a width of the projection in a direction perpendicular to the projecting direction at a chamber-side opening face of the ejection opening is represented as a1 and a maximum width of the projection in the direction perpendicular to the projecting direction is represented as a2, a relation of the formula a1<a2 is established and the width of the projection decreases from a position having the width of a2 to the chamber-side opening face along the direction of ejecting the liquid to the outside from the chamber.

2. The print head according to claim 1, wherein the ejection opening only includes the projection as a first projection and a second projection.

3. The print head according to claim 2, wherein the first and second projections are provided such that the projecting direction is parallel to a direction of supplying the liquid to the chamber.

4. The print head according to claim 3, wherein in a cross-section taken along a direction perpendicular to the direction of supplying the liquid to the chamber and along the direction of ejecting the liquid to the outside from the chamber, each of the first and second projections is formed in a tapered shape having the maximum width a2 on an atmosphere-side opening face of the ejection opening and decreasing in width from the atmosphere-side opening face to the chamber-side opening face of the ejection opening.

5. The print head according to claim 3, wherein in a cross-section taken along a direction perpendicular to the direction of supplying the liquid to the chamber and along the direction of ejecting the liquid to the outside from the chamber, the ejection opening is formed in a tapered shape such that a configuration in an imaginary view with the first and second projections being removed gradually increases from an atmosphere-side opening face toward the chamber-side opening face.

6. The print head according to claim 3, wherein in a cross-section taken along a direction perpendicular to the direction of supplying the liquid to the chamber and along the direction of ejecting the liquid to the outside from the chamber, each of the first and second projections has the maximum width a2 on an atmosphere-side opening face of the ejection opening and a width decreasing in discrete intervals from the atmosphere-side opening face toward the chamber-side opening face of the ejection opening.

7. The print head according to claim 6, wherein in the cross-section taken along the direction perpendicular to the direction of supplying the liquid to the chamber and along the direction of ejecting the liquid to the outside from the chamber, the ejection opening has a configuration, in an imaginary view with the first and second projections being removed, to increase in discrete intervals from the atmosphere-side opening face toward the chamber-side opening face.

8. The print head according to claim 2, wherein the first and second projections project in the projecting direction and a parallel and opposite direction, respectively, which are perpendicular to a direction of supplying the liquid to the chamber.

9. The print head according to claim 8, wherein in a cross-section taken along a direction parallel to the direction of supplying the liquid to the chamber and along the direction of ejecting the liquid to the outside from the chamber, each of the first and second projections is formed in a tapered shape having the maximum width a2 on an atmosphere-side opening face of the ejection opening and decreasing in width from the atmosphere-side opening face toward the chamber-side opening face of the ejection opening.

10. The print head according to claim 8, wherein in a cross-section taken along a direction parallel to the direction of supplying the liquid to the chamber and along a direction of ejecting the liquid to the outside from the chamber, the ejection opening is formed in a tapered shape such that a configuration in an imaginary view with the first and second projections being removed increases from an atmosphere-side opening face to the chamber-side opening face.

11. The print head according to claim 8, wherein in a cross-section taken along a direction parallel to the direction of supplying the liquid to the chamber and along a direction of ejecting the liquid to the outside from the chamber, each of the first and second projections has the maximum width a2 on an atmosphere-side opening face of the ejection opening and a width decreasing in discrete intervals from the atmosphere-side opening face toward the chamber-side opening face of the ejection opening.

12. The print head according to claim 11, wherein in a cross-section taken along a direction parallel to the direction of supplying the liquid to the chamber and along the direction of ejecting the liquid to the outside from the chamber, the ejection opening has a configuration, in a view with the first and second projections being removed, to increase in discrete intervals from the atmosphere-side opening face toward the chamber-side opening face.

13. The print head according to claim 1, wherein the width of the projection decreases at a constant slope from the position having the width of a2 to the chamber-side opening face along the direction of ejecting the liquid to the outside from the chamber.

14. The print head according to claim 13, wherein the width of a1 at the chamber-side opening face is zero.

15. The print head according to claim 1, wherein the width of the projection decreases at discrete intervals from the position having the width of a2 to the chamber-side opening face along the direction of ejecting the liquid to the outside from the chamber.

16. An inkjet printing apparatus using a print head comprising:

an energy generating element;

a chamber for accommodating liquid to which energy is applied from the energy generating element; and an ejection opening arranged in a position facing the energy generating element for ejecting the liquid from the chamber to outside, the energy being applied to the liquid in the chamber from the energy generating element to eject the liquid from the ejection opening, wherein the ejection opening includes at least one projection projecting in a projecting direction from an edge of the ejection opening towards a central portion of the ejection opening, the ejection opening having a first region between a front end of the projection and an inner wall of the ejection opening positioned at the shortest distance from the front end of the projection, and second regions positioned at both sides of the projection and being different from the first region, and wherein, when viewed from a direction of ejecting the liquid to the outside from the chamber, when a width of the projection in a direction perpendicular to the projecting direction at a chamber-side opening face of the ejection opening is represented as a1 and a maximum width of the projection in the direction perpendicular to the projecting direction is represented as a2, a relation of the formula a1<a2 is established and the width of the projection decreases from a position having the width of a2 to the chamber-side opening face along the direction of ejecting the liquid to the outside from the chamber.

* * * * *